US006116859A

United States Patent [19]

Bodzak et al.

[11] Patent Number: 6,116,859

[45] Date of Patent: Sep. 12, 2000

[54] PRESSURE OPERATED BY-PASS VALVE DISPOSED IN THE COVER OF A FEED PUMP FOR REVERSE FLOW

[75] Inventors: Stanislaw Bodzak, Elsbethen; Hanspeter Mayer, Adnet, both of Austria

[73] Assignee: Robert Bosch GmbH, Stuttgart, Germany

[21] Appl. No.: 08/934,140

[22] Filed: Sep. 19, 1997

[30] Foreign Application Priority Data

Sep. 19, 1996 [DE] Germany ..... 196 38 335

[51] Int. Cl.[7] ..... F04B 49/00

[52] U.S. Cl. ..... 417/310; 417/454

[58] Field of Search ..... 417/310, 454

[56] References Cited

U.S. PATENT DOCUMENTS

| | | | |
|---|---|---|---|
| 4,138,204 | 2/1979 | Bruguera | 417/310 |
| 5,236,317 | 8/1993 | Lonsberry | 417/310 |
| 5,338,161 | 8/1994 | Eley | 417/310 |
| 5,597,291 | 1/1997 | Bodzak et al. | 417/310 |

FOREIGN PATENT DOCUMENTS

| | | | |
|---|---|---|---|
| 711046 | 6/1965 | Canada | 417/310 |
| 0 301 886 | 7/1988 | European Pat. Off. . | |
| 2 706 541 | 6/1993 | France . | |
| 2254316 | 5/1974 | Germany | 417/310 |
| 75 07 541 | 9/1976 | Germany . | |
| 44 41 505A1 | 5/1996 | Germany | 417/310 |

*Primary Examiner*—Timothy S. Thorpe
*Assistant Examiner*—Cheryl J. Tyler
*Attorney, Agent, or Firm*—Edwin E. Greigg; Ronald E. Greigg

[57] ABSTRACT

A feed pump having a pair of gears that mesh with each other and are driven to rotate in a pump chamber. The gears supply a feed medium from an intake chamber connected to a storage tank, along a supply conduit constituted between the end face of the gears and the circumferential wall of the pump chamber. The feed medium is pumped into a pressure chamber, and a bypass conduit that connects the intake chamber to the pressure chamber can be opened by means of a pressure valve disposed in the bypass conduit. The bypass conduit that contains the pressure valve is disposed in a housing cover that closes the housing of the feed pump. The housing cover can be rotated 180 degrees in order to reverse the flow of the fluid medium within the pump.

12 Claims, 1 Drawing Sheet

PRESSURE OPERATED BY-PASS VALVE DISPOSED IN THE COVER OF A FEED PUMP FOR REVERSE FLOW

BACKGROUND OF THE INVENTION

The invention is based on a feed pump for an internal combustion engine. A feed pump of this kind has been disclosed by DE 44 41 505; U.S. Pat. No. 5,597,291, and is used there for feeding fuel from a storage tank to a fuel injection pump of an internal combustion engine.

The feed pump is embodied as a geared feed pump which has a pair of gears that engage in an externally meshed fashion. The rotationally driven pair of gears feeds fuel from an intake chamber connected to the storage tank, along a supply conduit constituted between the end faces of the gears and the circumferential wall of the pump chamber, and into a pressure chamber from which a supply line leads to the fuel injection pump.

To control the pressure in the pressure chamber or the feed quantity of the feed pump, a bypass conduit is provided between the pressure chamber and the intake chamber in the pump housing of the feed pump, and a pressure valve that opens in the direction of the intake chamber is inserted into this bypass conduit. The opening of the bypass conduit is carried out via the pressure valve, which unblocks a particular opening cross section in the bypass conduit at a particular pressure differential between the pressure chamber and the intake chamber, as a function of the spring force of the valve spring. The opening time and opening stroke can be adjusted via the initial stress of the valve spring of the pressure valve, which is why it is possible to adjust the axial position of a clamping sleeve that acts as a counter-support.

Due to the fixed disposition of the bypass conduit in the pump housing, the known feed pump has the disadvantage that the individual feed pumps can only be used as clockwise or counter-clockwise feed pumps so that different feed pump types are required for different drive rotation directions, which increases manufacturing costs and limits a flexible utility of the feed pumps.

OBJECT AND SUMMARY OF THE INVENTION

The feed pump according to the invention has the advantage over the prior art that it can be used as both a clockwise pump and a counterclockwise pump. This is made possible in a simple manner according to the invention, by providing the bypass conduit in the feed pump housing cover that closes the pump chamber. The bypass conduit is constituted in a structurally simple manner by means of a longitudinal bore in the pump cover, running crosswise to the axis of the gears, the open end of this bore can be closed by means of a stopper, and from this longitudinal bore, one lateral bore feeds into the intake chamber and another lateral bore feeds into the pressure chamber of the feed pump. The longitudinal bore of the bypass conduit is provided in the cover in the vicinity of the tooth engagement line (contact line) of the gears that mesh with each other so that the lateral bores of the bypass conduit still feed into the pump chamber even when the cover is mounted rotated by 180° around the pump axis. Since the bypass conduit, however, is slid out of the central plane constituted at the contact line of the gears, the effect commences that depending on the rotational position of the cover, the respective lateral bores feed into the pump chamber area situated on the left or into the pump chamber area situated on the right. In this manner, while maintaining the functional direction of the pressure valve inserted into the bypass conduit, a simple rotation of the pump cover can permit a clockwise and a counterclockwise function with only one feed pump construction and one bypass conduit.

The inlet and outlet openings or intake and pressure openings of the pump chamber are advantageously disposed on the contact line of the gears and thus likewise feed reliably into the respective pump chamber in both assembly positions. It is advantageous to provide the supply line or the intake opening with a cross sectional narrowing that constitutes a suction throttle to be correspondingly tuned.

For different requirements, a second bypass conduit can also be provided in the pump cover, which is then disposed on the opposite side in the pump cover, on the other side of the contact line of the gears.

The feed pump according to the invention is particularly suited for feeding fuel from a storage tank to a fuel injection pump of an internal combustion engine, but can also be used to feed other fluid feed mediums.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
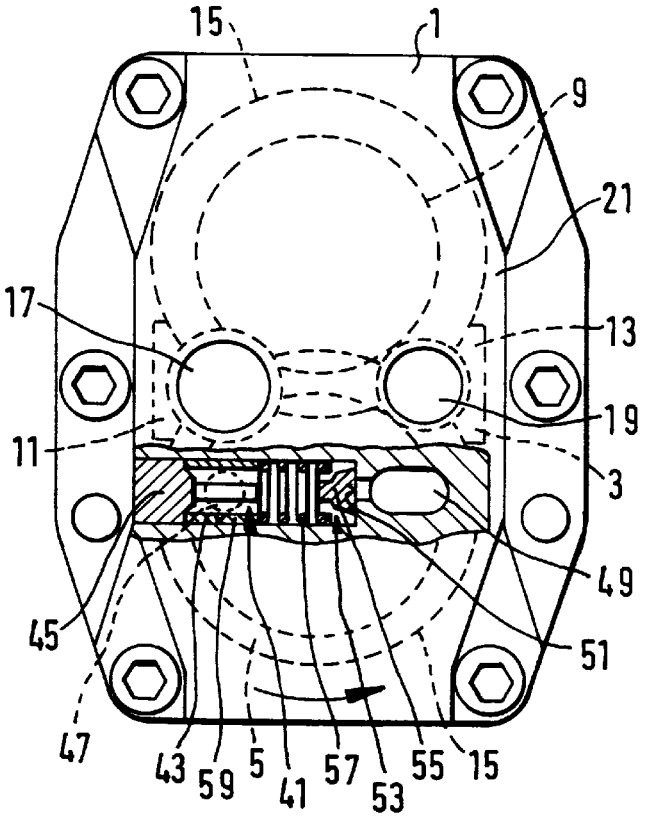
FIG. 1 shows a view of the cover side of the feed pump with a cut-out bypass conduit and the representation of the position of the gears.
Figure 2:
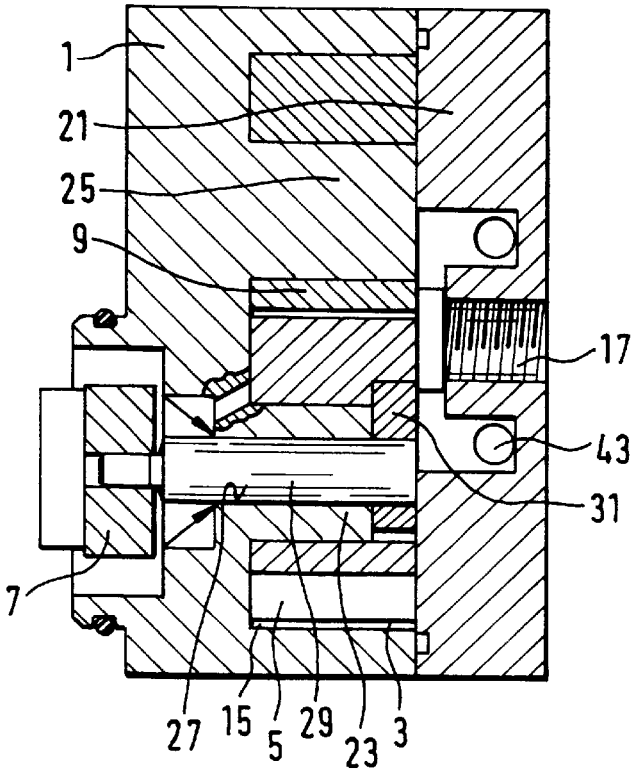
FIG. 2 shows a sectional representation of the feed pump in a view rotated by 90° in comparison to FIG. 1.

The feed pump according to the invention represented in two views in FIGS. 1 and 2 is inserted into a supply line, not shown, from a storage tank to a fuel injection pump for internal combustion engines.

The exemplary embodiment of the feed pump represented in FIGS. 1 and 2 has a pump chamber 3 in its housing 1 and a rotationally driven pair of gears that mesh with each other is disposed in this chamber.

A first gear 5, disposed on the bottom in the exemplary embodiment, is driven to rotate by means of an external drive element 7, not shown in precise detail, and transmits this rotary motion via an end face gearing to a second gear 9 that meshes with the first gear 5.

By means of their toothed engagement, the gears 5, 9 divide the pump chamber 3 into two subregions of which a first subregion constitutes an intake chamber 11 and a second part constitutes a pressure chamber 13.

The intake chamber 11 communicates with the pressure chamber 13 via the respective supply conduit 15 constituted between the tooth grooves on the end faces of the first and second gear 5, 9 and the upper and lower circumferential wall of the pump chamber 3. Furthermore, the intake chamber 11 and the pressure chamber 13 each have a connection opening in the wall of the pump housing 1 via which the intake chamber 11 communicates with an intake line, not shown, from the storage tank and via which the pressure chamber 13 communicates with a supply line, likewise not shown, to the inlet chamber of the fuel injection pump. The connection opening into the intake chamber 11 constitutes an intake or inlet opening 17 and the connection opening into the pressure chamber 13 constitutes a pressure or outlet opening 19, which are disposed in a housing cover 21 that closes the pump chamber 3, wherein the inlet opening has a cross sectional reduction, not shown in detail, that constitutes a suction throttle.

The gears 5, 9 are supported on housing pins, which protrude into the interior of the pump housing 1 and are embodied as being of one piece with the pump housing 1. A first housing pin 23 disposed at the bottom constitutes a bearing pin that receives the first gear 5 and a second housing pin 25 disposed at the top constitutes a bearing pin that receives the second gear 9.

The first housing pin 23 has an axial through bore 27 in which a drive shaft 29 is guided, which on its end remote from the housing cover 21 is connected in a non-rotating manner to the drive element 7.

On its end remote from the drive element 7, the drive shaft 29 protrudes out of the bore 27 of the first housing pin 23 into a coupling member 31 to the first gear 5, via which the rotary motion of the drive shaft 29 is transmitted to the gear 5.

Furthermore, a bypass conduit 41 is provided for a pressure control of the feed pressure in the pressure chamber 13 and consequently to regulate the feed quantity. This bypass conduit 41 which connects the pressure chamber 13 to the intake chamber 11 is disposed in the housing cover 21 and is constituted by a longitudinal bore 43 in the housing cover 21, running perpendicular to the axis of the gears 5, 9. The longitudinal bore 43 is embodied as a blind bore whose open end is closed by means of a closing stopper 45 or alternatively by means of a ball. The longitudinal bore 43 is disposed at close proximity beneath a contact line of the gears 5, 9 that mesh with each other, at which line the pump chamber 3 is divided into the intake chamber 11 and the pressure chamber 13, but it does not intersect this contact line.

At each of the ends of the longitudinal bore 43, a lateral opening leads into the pump chamber 3, wherein a first lateral opening 47 feeds into the intake chamber 11 situated on the left in the exemplary embodiment and a second lateral opening 49 feeds into the pressure chamber 13 situated on the right.

On the end near the pressure chamber, the longitudinal bore 43 of the bypass conduit 41 has a cross sectional reduction formed in the direction of the pressure chamber 13 by a shoulder that constitutes a valve seat 51 of a pressure valve 53, which is inserted into the bypass conduit 41 and opens in the direction of the intake chamber 11. A disk-shaped valve closing member 55 of the pressure valve 53 comes into sealing contact with this valve seat 51 and this valve closing member is acted upon by a valve spring 57 on its end remote from the valve seat. This valve spring 57, which is embodied as a compression spring and acts on the valve closing member 55, is supported on the other end against the annular end face of a slotted clamping sleeve 59, which is pressed into the intake chamber end of the longitudinal bore 43 and whose axial penetration depth can be used to adjust the initial stress of the valve spring 57.

The first lateral opening 47 is disposed in the region of the overlap with the clamping sleeve 59 and the second lateral opening 49 is disposed in the region of the longitudinal bore 43 that adjoins the valve seat 51 on the pressure chamber end.

FIG. 1 represents a so-called clockwise feed pump in which the drive shaft 29 rotates clockwise (and rotates in the other direction on the opposite side of the cover), wherein the intake chamber 11 is disposed on the left and the pressure chamber 13 is disposed on the right in the cover view.

If the rotational direction of the drive shaft 29 is now reversed, the right chamber (formerly pressure chamber) of the pump chamber 3 now functions as the intake chamber and the left chamber (formerly intake chamber) functions as the pressure chamber.

In order to furthermore be able to carry out a pressure control via the bypass valve, the housing cover 21 is now removed and rotated by 180° around the pump axis and remounted so that the longitudinal bore 43 of the bypass conduit 41 is now disposed above the contact line of the gears 5, 9. The first lateral opening 47, which is now on the other side, feeds into the intake chamber 11 once again and the second lateral opening 49 feeds into the pressure chamber 13 again.

The feed pump according to the invention functions in the following manner. In the operation of the feed pump, the drive shaft 29 is preferably driven to rotate proportional to the speed of the engine to be fed. The drive shaft 29 transmits the rotary motion via the coupling member 31 to the first gear 5, which in turn drives the second gear 9 to rotate, which meshes with it. As a result of the rotary motion of the gears 5, 9, which mesh with each other, the feed medium, preferably fuel, is fed from the intake chamber 11, along the supply conduits 15, and into the pressure chamber 13. In the intake chamber 11, a vacuum is produced which is sufficient to aspirate additional fuel from the storage tank via the intake line. The fuel pressure built up in the pressure chamber 13 produces a fuel supply via the outlet opening 19 into the supply line to the fuel injection pump.

The control of the maximal feed pressure and of the maximal feed quantity takes place at the outlet opening 17 to the supply line via the bypass conduit 41 by virtue of the fact that the valve closing member 55 of the pressure valve 53 inserted in it lifts up from the valve seat 51 starting at a particular pressure in the pressure chamber 13 and thus opens a draining cross section in the bypass conduit 41 via which a part of the pressurized feed quantity drains out of the pressure chamber 13 into the intake chamber 11, wherein the opening pressure of the pressure valve 53 can be adjusted via the initial stress of the valve spring 57.

The foregoing relates to preferred exemplary embodiments of the invention, it being understood that other variants and embodiments thereof are possible within the spirit and scope of the invention, the latter being defined by the appended claims.

The invention claimed and desired to be secured by letters patent of the U.S. is:

1. A feed pump comprising a housing, a pair of gears (5, 9) that mesh with each other and are driven to rotate in a pump chamber (3) in said housing, said pair of gears supply a feed medium from an intake chamber (11) along a supply conduit (15) of said feed pump constituted between an end face of the gears (5, 9) and a circumferential wall of the pump chamber (3) into a pressure chamber (13), a bypass conduit (41) that connects the intake chamber (11) to the pressure chamber (13) is opened by means of a pressure valve (53) disposed in said bypass conduit, the bypass conduit (41) that contains the pressure valve (53) is disposed in a housing cover (21) that closes the housing (1) of the feed pump and an inlet opening (17) that feeds into the intake chamber (11) and a pressure opening (19) that feeds into the pressure chamber (13) are disposed in the housing cover (21).

2. A feed pump according to claim 1, in which the bypass conduit (41) is embodied as a longitudinal bore (43) in the housing cover (21) and directed perpendicular to an axis of the gears (5,9), said bypass conduit is connected via a lateral opening respectively to the intake chamber (11) and the pressure chamber (13) of the pump chamber (3).

3. A feed pump according to claim 2, in which the longitudinal bore (43) that constitutes the bypass conduit (41) in the housing cover (21) is embodied as a blind bore having an open end which is closed with a closing element.

4. A feed pump according to claim 2, in which the longitudinal bore (43) of the bypass conduit (41) is disposed in the housing cover (21) so that in a first assembly position of the housing cover (21) on the pump housing (1), a first lateral opening (47) feeds into the intake chamber (11) and a second lateral opening (49) feeds into the pressure chamber (13).

5. A feed pump according to claim 4, in which in a second assembly position of the housing cover the bypass conduit (41) is disposed in the housing cover (21) in such a way that the housing cover (21) is rotated by 180° around the pump axis and mounted on the pump housing (1), in the second assembly position the lateral openings (47, 49) leading from the longitudinal bore (43) feed into different chambers of the pump chamber (3).

6. A feed pump according to claim 5, in which in said second assembly position, the first and second lateral opening (47, 49) feed into spatially opposing chambers of the pump chamber (3).

7. A feed pump according to claim 4, in which the clamping sleeve (59) is embodied as slotted and that the first lateral opening (47) of the bypass conduit (41) leads from the longitudinal bore (43) in the housing cover at a level of the clamping sleeve (59) and the second lateral opening (49) leads from the longitudinal bore (43) on an end of the valve seat (51) remote from the valve spring (57).

8. A feed pump according to claim 1, in which on its pressure chamber end, the bypass conduit (41) has a cross sectional reduction that forms a valve seat face (51), and a valve spring (57) that forces a sealing face of a valve closing member (55) of the pressure valve (53) into contact with said valve seat face, said spring is supported on another end against a clamping sleeve (59) that is inserted into the intake chamber end of the bypass conduit (41).

9. A feed pump according to claim 8, in which the clamping sleeve (59) is embodied as slotted and that the first lateral opening (47) of the bypass conduit (41) leads from the longitudinal bore (43) in the housing cover at a level of the clamping sleeve (59) and the second lateral opening (49) leads from the longitudinal bore (43) on an end of the valve seat (51) remote from the valve spring (57).

10. A feed pump according to claim 1, in which the inlet opening (17) and the pressure opening (19) in the housing cover (21) are disposed at a level of the contact line of the gears (5, 9) that mesh with each other.

11. A feed pump according to claim 1, in which a cross sectional reduction constituting a suction throttle is provided in the inlet opening (17).

12. A feed pump according to claim 1, in which fuel is fed from a fuel storage tank to a fuel injection pump of an internal combustion engine.

* * * * *